US008281630B2

(12) United States Patent
Mizumura et al.

(10) Patent No.: US 8,281,630 B2
(45) Date of Patent: Oct. 9, 2012

(54) METHOD FOR HYDROFORMING AND A HYDROFORMED PRODUCT

(75) Inventors: Masaaki Mizumura, Tokyo (JP); Koichi Sato, Tokyo (JP); Manabu Wada, Tokyo (JP); Yukihisa Kuriyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/737,321

(22) PCT Filed: Jun. 30, 2009

(86) PCT No.: PCT/JP2009/062260

§ 371 (c)(1),
(2), (4) Date: Dec. 29, 2010

(87) PCT Pub. No.: WO2010/002027

PCT Pub. Date: Jan. 7, 2010

(65) Prior Publication Data

US 2011/0097596 A1 Apr. 28, 2011

(30) Foreign Application Priority Data

Jul. 4, 2008 (JP) ..... 2008-175764
May 20, 2009 (JP) ..... 2009-122181

(51) Int. Cl.
*B21D 22/10* (2006.01)

(52) U.S. Cl. ..... 72/58; 72/60; 72/61; 72/370.22; 29/421.1

(58) Field of Classification Search ..... 72/58, 60, 72/61, 62, 370.22; 29/421.1
See application file for complete search history.

(56) References Cited

U.S. PATENT DOCUMENTS 6,014,879 A * 1/2000 Jaekel et al. ..... 72/61
(Continued)

FOREIGN PATENT DOCUMENTS

JP 2000-042646 2/2000
(Continued)

OTHER PUBLICATIONS

"Influence of pressure oscillation on deformation behavior in hammering hydroforming of tubes," Proceedings of the 2004 Japanese Spring Conference for the Technology of Plasticity, p. 405-406 (May 21, 2004).

(Continued)

*Primary Examiner* — David B Jones
(74) *Attorney, Agent, or Firm* — Kenyon & Kenyon LLP

(57) ABSTRACT

The invention has as its object to perform hydroforming so that no buckling or wrinkles remain at a hydroformed product with a long expanded region and comprises performing a first step of raising the internal pressure in a state with the metal tube fixed in position at the two ends or a state applying axial pushing actions of 10% or less of the total amount of axial pushing action, then applying axial pushing actions while holding the internal pressure at a constant pressure so as to expand the metal tube near the ends, then performing a second step of raising only the internal pressure without applying any axial pushing action so as to thereby expand a center of the metal tube, then performing a third step of lowering only the internal pressure to the value of the constant pressure without applying any axial pushing action, then repeating the first to third steps one or more times, then raising the internal pressure in the state not applying any axial pushing action or applying an axial pushing action of 10% of the total axial pushing action amount or less.

2 Claims, 11 Drawing Sheets

U.S. PATENT DOCUMENTS

| | | | | |
|---|---|---|---|---|
| 6,041,633 | A * | 3/2000 | Bieling | 72/61 |
| 6,128,936 | A * | 10/2000 | Yogo | 72/58 |
| 6,151,940 | A * | 11/2000 | Amborn et al. | 72/62 |
| 6,237,382 | B1 * | 5/2001 | Kojima et al. | 72/58 |
| 6,415,638 | B1 * | 7/2002 | Sakurai et al. | 72/57 |
| 6,530,252 | B1 * | 3/2003 | Hashimoto et al. | 72/58 |
| 6,912,884 | B2 * | 7/2005 | Gharib | 72/58 |
| 7,051,564 | B2 * | 5/2006 | Chang | 72/58 |

FOREIGN PATENT DOCUMENTS

| | | |
|---|---|---|
| JP | 2000-084625 | 3/2000 |
| JP | 2003-039121 | 2/2003 |
| JP | 2003-285124 | 10/2003 |
| JP | 2004-230433 | 8/2004 |
| JP | 2004-314151 | 11/2004 |
| JP | 2006-000870 | 1/2006 |
| JP | 2008-105053 | 5/2008 |

OTHER PUBLICATIONS

"Effect of loading path on formation limit of hydroforming of rectangular section," Proceedings of the 2000 Japanese Spring Conference for the Technology of Plasticity, p. 433-434 (May 26, 2000).

International Search Report dated Aug. 18, 2009 issued in corresponding PCT Application No. PCT/JP2009/062260.

* cited by examiner a b

METHOD FOR HYDROFORMING AND A HYDROFORMED PRODUCT

This application is a national stage application of International Application No. PCT/JP2009/062260, filed 30 Jun. 2009, which claims priority to Japanese Application Nos. 2008-175764, filed 04 Jul. 2008; and 2009-122181, filed 20 May 2009, each of which is incorporated by reference in its entirety.

TECHNICAL FIELD

The present invention relates to a method for hydroforming placing a metal tube in a mold, clamping the mold, then applying internal pressure in the tube and a pushing action in the tube axial direction (hereinafter referred to as an "axial pushing action") to form the tube into a predetermined shape and to a hydroformed product formed by the same.

BACKGROUND ART

In recent years, applications for hydroforming have been growing—particularly in the field of auto parts. The advantages of hydroforming are that it is possible to form an auto part, which used to be made from several press-formed parts, from a single metal tube, that is, combine parts and thereby reduce costs, and reduce the number of welding locations and thereby lighten the weight.

However, the metal tube used as a material is generally uniform in cross-section, so a shape with a large expansion rate (ratio to circumferential length of tube of circumferential length after hydroforming) was difficult to work.

Further, the difficulty of hydroforming is not only affected by the expansion rate, but is also affected by the cross-sectional shape or presence of any bending. In particular, the length of the location expanded has a large effect.

For example, with the T-shape such as in FIG. 1(*a*), the expanded length is short, so working is easily possible even with a 1.6 or more large expansion rate. As opposed to this, with a shape with a long expanded location such as in FIG. 1(*b*), working is difficult even if the expansion rate is not that large.

In hydroforming of a long expanded location, unless applying a considerably large axial pushing action, the tube will become thin in wall thickness and end up cracking, but the larger the axial pushing action, the easier the tube will buckle or wrinkle in the tube axial direction.

Further, a long expanded location means that in that region, in the initial state, the metal tube and the mold will not yet be in contact, so buckling or wrinkles will occur more easily.

So far as the inventors know, in the region of an expansion rate of 1.35 or more, hydroforming to 3.5 times or more the outside diameter of the original metal tube is not seen.

In general, to prevent buckling or wrinkles in the hydroforming, it is important to test different load paths of internal pressure and axial pushing action (hereinafter referred to as simple a "load path") by trial and error to find the suitable load path.

A general example of the load path is shown in FIG. 2. First, it is comprised of stage 1 of raising only the internal pressure (to seal the tube ends, sometimes slight axial pushing actions are also given), stage 2 of applying the internal pressure and axial pushing actions in a broken line pattern, and stage 3 of raising only the internal pressure for obtaining sharp radii of curvature of the corners (with shapes with no corners, sometimes this is omitted, while to secure a seal of the tube ends, sometimes slight axial pushing actions are also given).

Among these, finding a suitable path for stage 2 consumes the most effort and has relied heavily on the skill of the hydroforming workers.

Patent Document 1 introduces an example of this, but this method is a method of preparing in advance a crack limit line and a wrinkle limit line and selecting a load path between the two limit lines.

However, in actuality, it is difficult to prepare these two limit lines. Usually, a large number of experiments and trial and error in analysis of numerical values are required. Further, the limit lines are often broken lines. If so, the number of parameters for determining the broken lines becomes greater and therefore tremendous labor becomes necessary for the trial and error.

Further, Patent Document 2 proposes a method cyclically changing the internal pressure along with the axial pushing action. For example, this is a method of changing the internal pressure to a square wave (a) or sine wave (b) such as shown in FIG. 3.

This method is proposed as a method for preventing cracking, but later research reports that it is also effective in suppressing wrinkles (see Non-Patent Document 1). However, the load path of this method increases in variables such as the waveform, period, amplitude, etc. compared with the variables in the above-mentioned broken line load path, so finding a suitable load path method for becomes even more difficult.

As a method when hydroforming a shape with a long expanded region, other than the above method of using a load path, there is also the method of specially designing the mold.

For example, Patent Document 3 jointly uses movable molds and a counter to realize expansion in the long region while preventing buckling of the metal tube.

However, the mold structure of this method is extremely complicated, so the mold costs become higher. Further, the items controlled during working are not limited to the internal pressure and axial pushing actions (axial pushing actions by movable molds). Facilities enabling control of the retracted position of the counter also become necessary. Further, since the items controlled increase, finding a suitable load path requires greater skill and trial and error.

PRIOR ART DOCUMENTS

Patent Documents

Patent Document 1: Japanese Patent Publication (A) No. 2004-230433

Patent Document 2: Japanese Patent Publication (A) No. 2000-84625

Patent Document 3: Japanese Patent Publication (A) No. 2004-314151

Non-Patent Documents

Non-Patent Document 1: Proceedings of the 2004 Japanese Spring Conference for the Technology of Plasticity, (2004), p. 405

Non-Patent Document 2: Proceedings of the 2000 Japanese Spring Conference for the Technology of Plasticity, (2000), p. 433

SUMMARY OF THE INVENTION

Problem to be Solved by the Invention

The present invention proposes a method of working able to work a hydroformed product with a long expanded region without any buckling or wrinkles remaining, which method of working does not requiring skilled labor or trial and error much at all. Further, it proposes a hydroformed product worked by that method of working.

Means for Solving the Problems

To solve such a problem, the present invention has as its gist the following:

(1) A method for hydroforming feeding an inside of a metal tube with a pressure medium to apply internal pressure and applying an axial pushing action from the two ends of the metal tube so as to form the metal tube into a predetermined shape, the method for hydroforming characterized by performing a first step of raising the internal pressure in a state with the metal tube fixed in position at the two ends or a state applying an axial pushing action of 10% or less of the total amount of axial pushing action, then applying an axial pushing action while holding the internal pressure at a constant pressure so as to expand the metal tube near the ends, then performing a second step of raising only the internal pressure without applying an axial pushing action so as to thereby expand a center of the metal tube, then performing a third step of lowering only the internal pressure to the value of the constant pressure without applying an axial pushing action, then repeating the first to third steps one or more times, then raising the internal pressure in the state not applying an axial pushing action or applying an axial pushing action of 10% of the total axial pushing action amount or less.

(2) A method for hydroforming feeding an inside of a metal tube with a pressure medium to apply internal pressure, applying an axial pushing action from the two ends of the metal tube, and simultaneously applying an axial pushing action to the movable molds so as to form the metal tube into a predetermined shape, the method for hydroforming characterized by performing a first step of raising the internal pressure in a state with the metal tube fixed in position at the two ends or a state applying an axial pushing action of 10% or less of the total amount of axial pushing action, then simultaneously applying an axial pushing action to the two ends of the metal tube and the movable molds while holding the internal pressure at a constant pressure so as to expand the metal tube near the ends, then performing a second step of raising only the internal pressure without applying an axial pushing action to the two ends of the metal tube and an axial pushing action to the movable molds so as to thereby expand a center of the metal tube, then performing a third step of lowering only the internal pressure to the value of the constant pressure without applying an axial pushing action to the two ends of the metal tube and an axial pushing action to the movable molds, then repeating the first to third steps one or more times, then raising the internal pressure in the state not applying an axial pushing action or applying an axial pushing action of 10% of the total axial pushing action amount or less.

(3) A hydroformed product produced using a method for hydroforming as set forth in the (1) or (2), the hydroformed product characterized in that a region where a circumferential length of an expanded cross-section of the metal tube is expanded by 1.35 times or more compared with the circumferential length of the cross-section of the original metal tube continues in the tube axial direction of the metal tube for at least 3.5 times the outside diameter of the original metal tube.

Note that "near the end of the metal tube" in the present invention is defined as the region within 35% or more from the end of a metal tube compared with the length of the metal tube before applying the axial pushing action by a fixed internal pressure. Further, the "pressure medium" is a liquid, gas, or solid and includes rubber, low melting point metal, steel balls, and all other media which can transmit pressure.

Effect of the Invention

According to the present invention, hydroforming a shape with a long expanded region becomes easy. Due to this, the scope of application of hydroforming becomes greater and parts can be merged and weight reduced.

*a*: example of T-forming

*b*: example of hydroformed product with long expanded location

Figure 1:
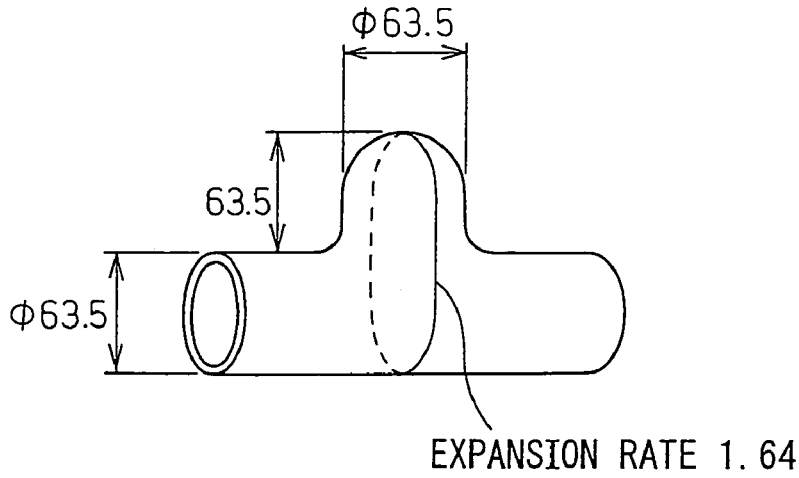
FIG. 1 shows an example of the shape of a hydroformed product.
Figure 1:
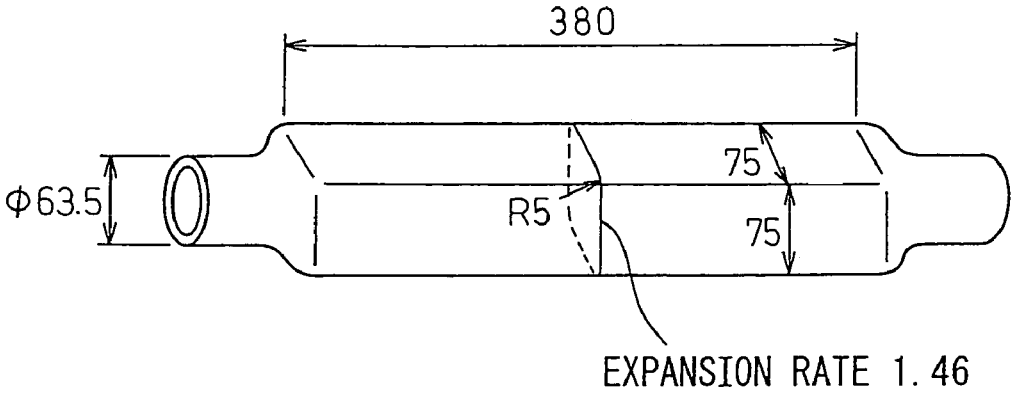
Figure 2:
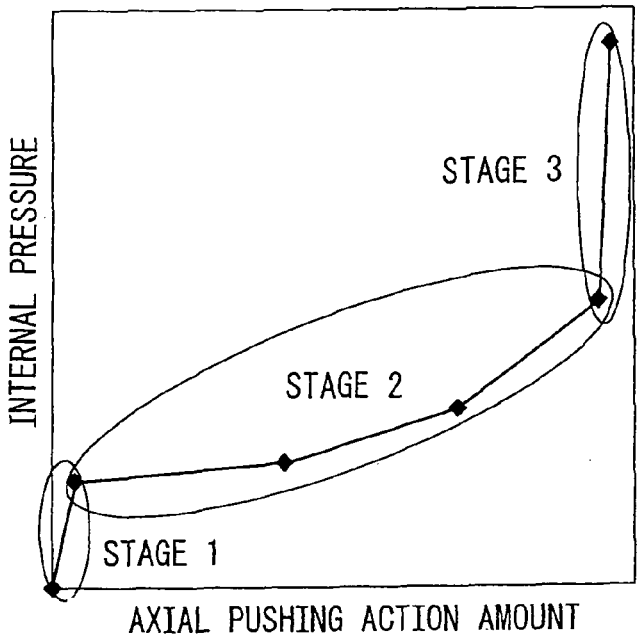

FIG. 2 is an explanatory view of a general load path of hydroforming.

Figure 3:
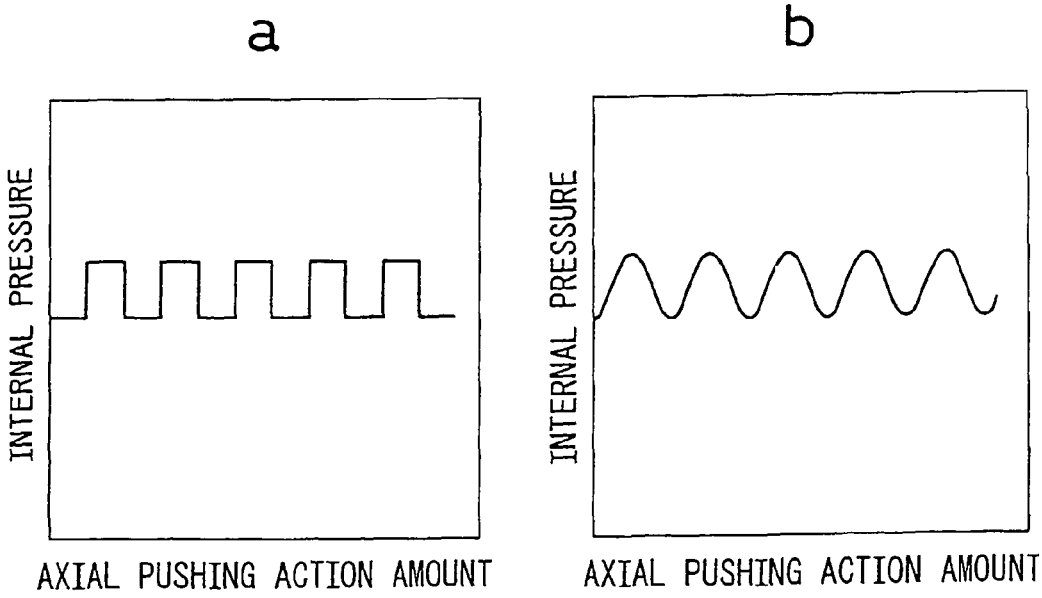

FIG. 3 shows an example of a cyclically changing conventional load path.

*a*: example of square wave

*b*: example of sine wave

Figure 4:
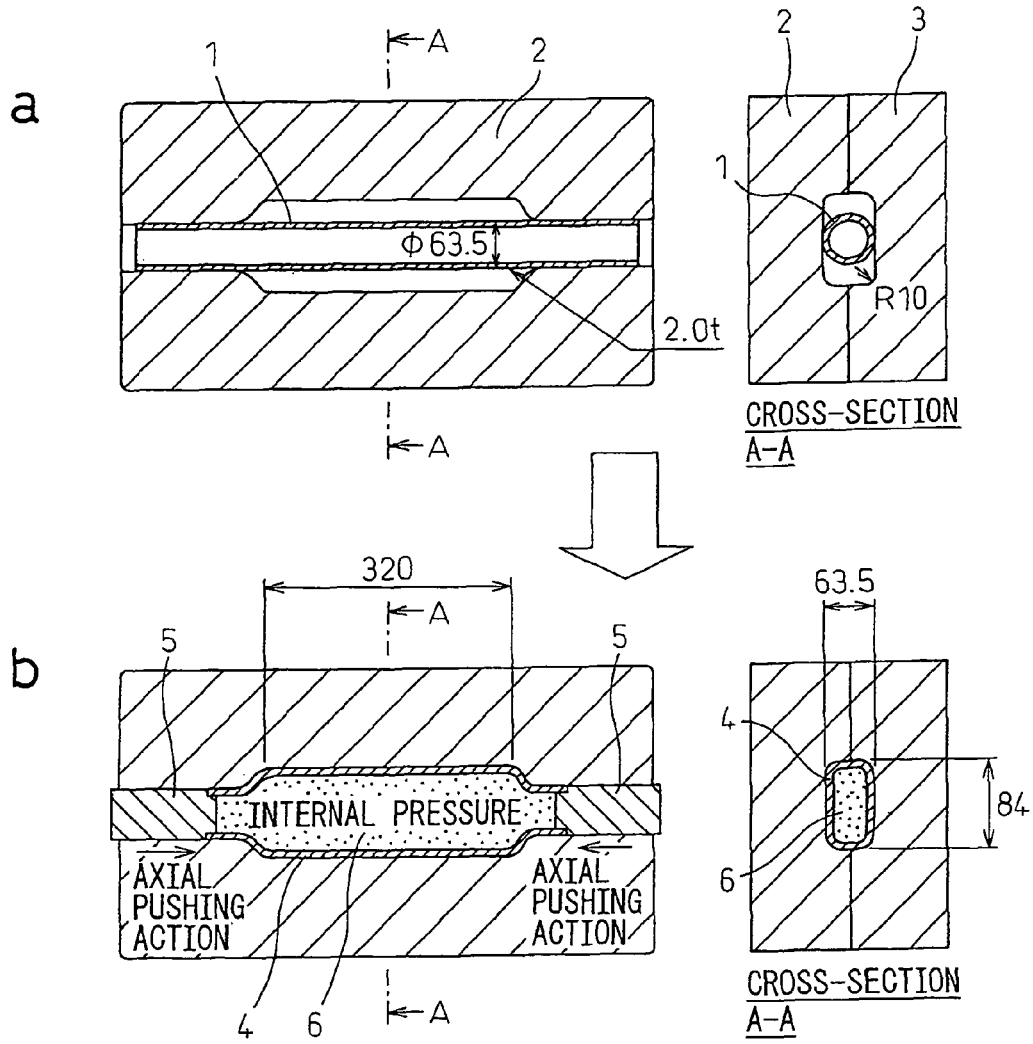

FIG. 4 is an explanatory view of a hydroform mold used in the method of the present invention.

*a*: example of state with metal tube set inside mold

*b*: example of state of metal tube finished being worked

Figure 5:
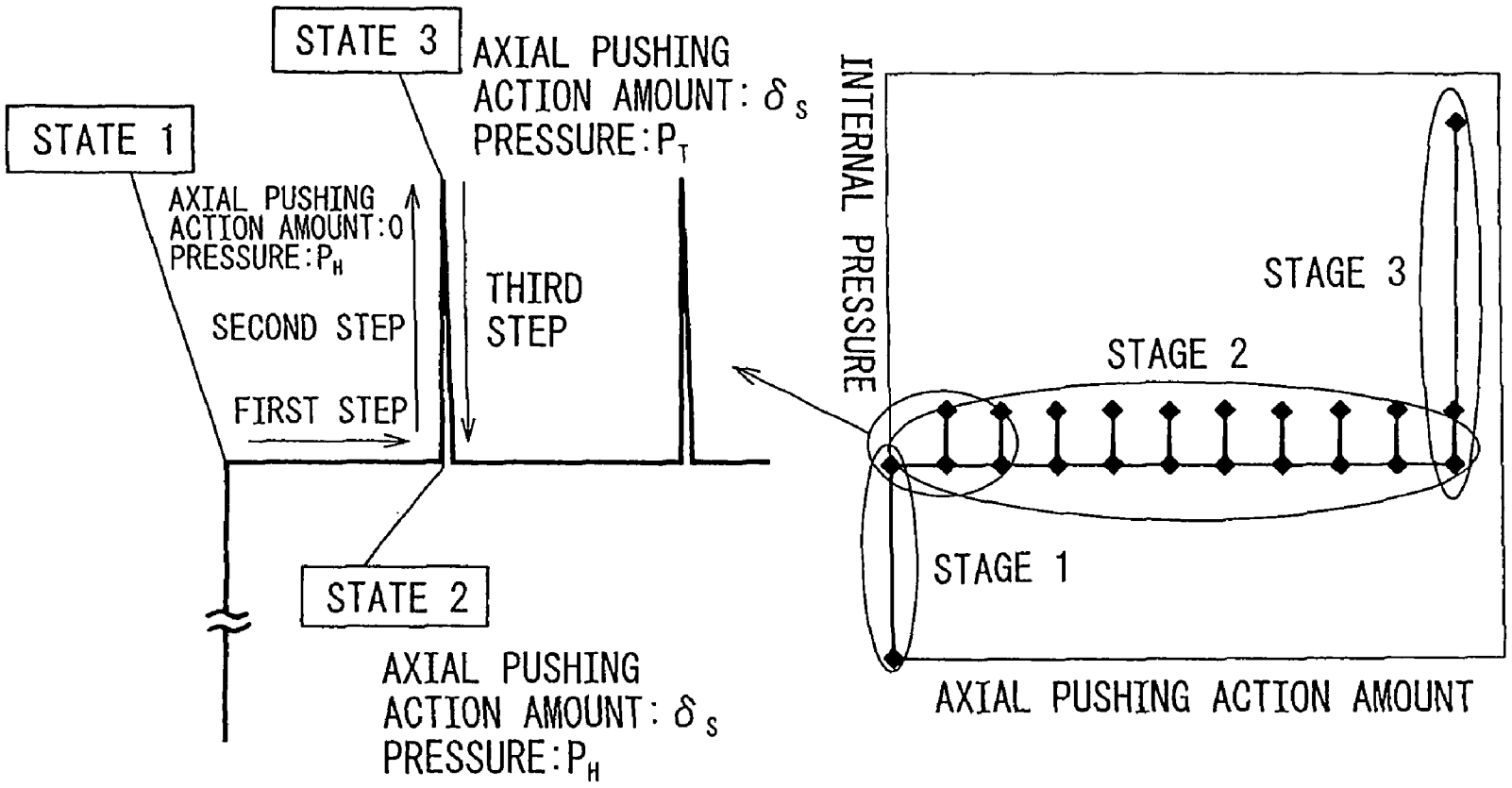

FIG. 5 is an explanatory view of a load path in the hydroforming method of the present invention.

Figure 6:
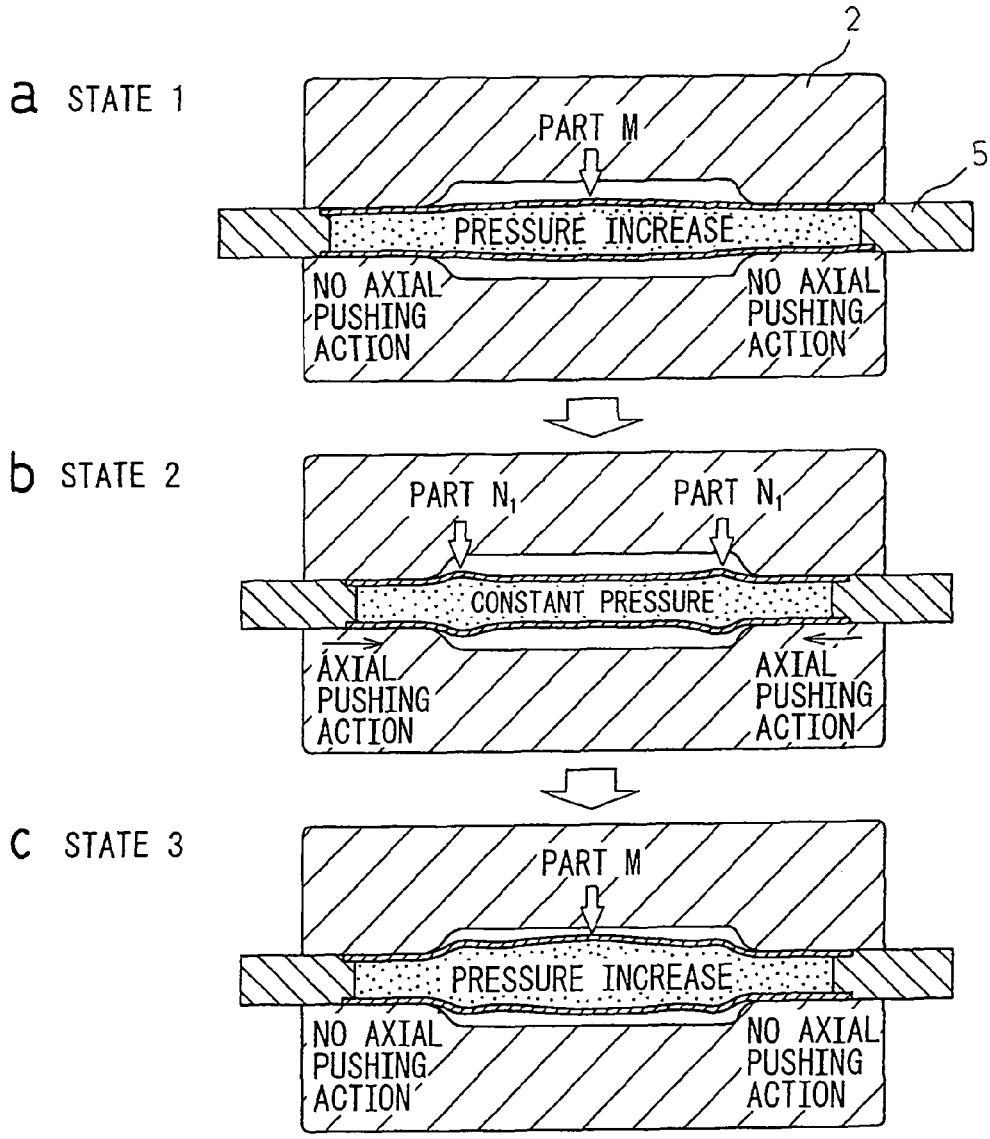

FIG. 6 is an explanatory view of the state of expansion in a working process of the present invention.

*a*: example of state 1, *b*: example of state 2, *c*: example of state 3

Figure 7:
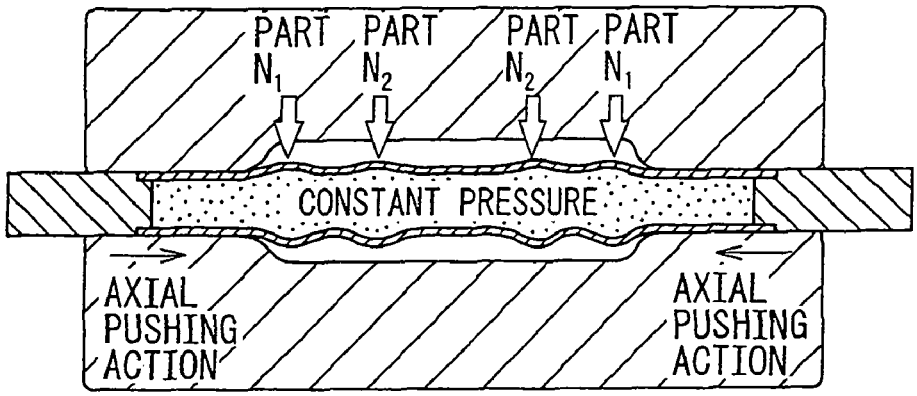

FIG. 7 is an explanatory view of an intermediate process where several expanded locations can be seen in the working process of the present invention.

Figure 8:
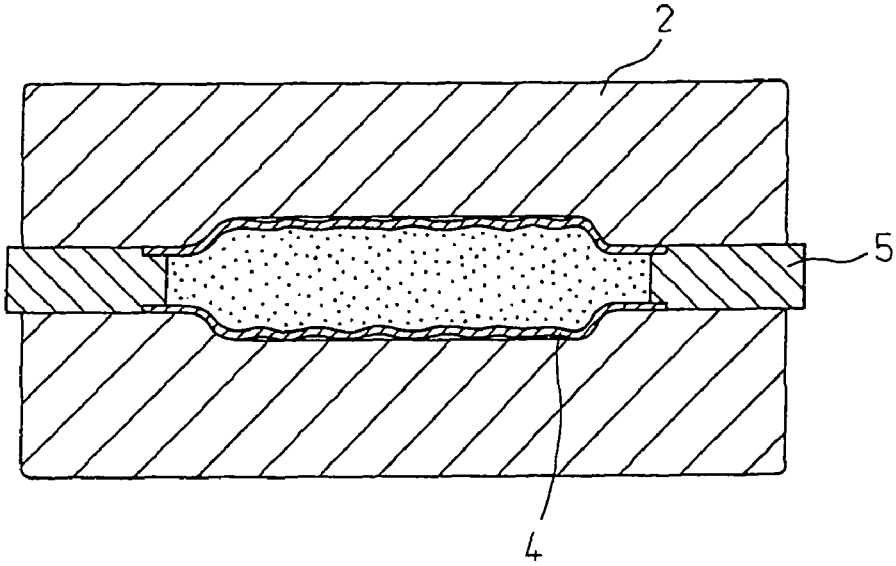

FIG. 8 is an explanatory view of an intermediate process in the state in substantially complete contact with the mold across the entire length in the working process of the present invention.

Figure 9:
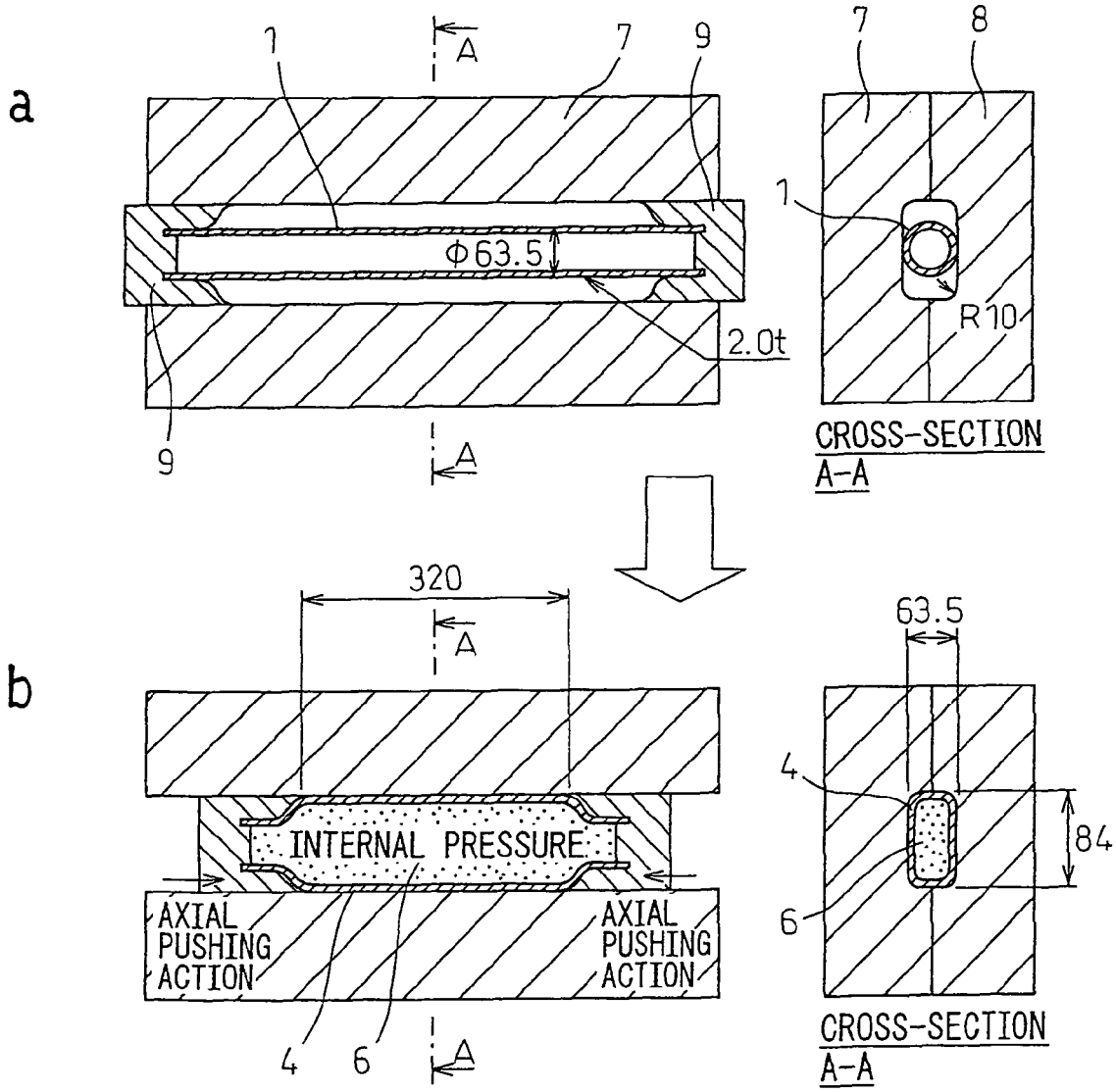

FIG. 9 is an explanatory view of a hydroform mold in the case of having movable molds used in the method of the present invention.

*a*: example of state with metal tube set inside mold

*b*: example of state of metal tube finished being worked

Figure 10:
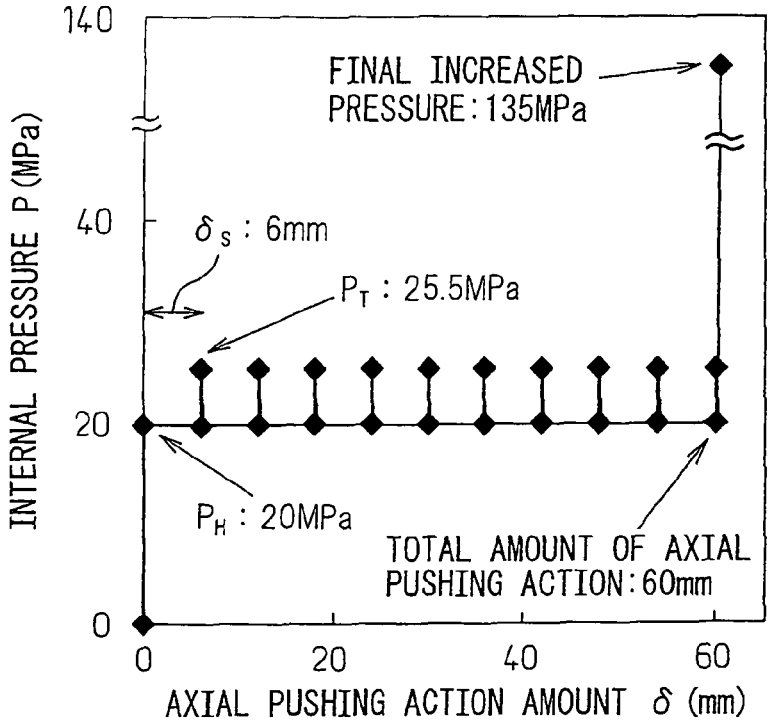

FIG. 10 is an explanatory view of a load path used in Example 1 and Example 2 of the present invention.

Figure 11:
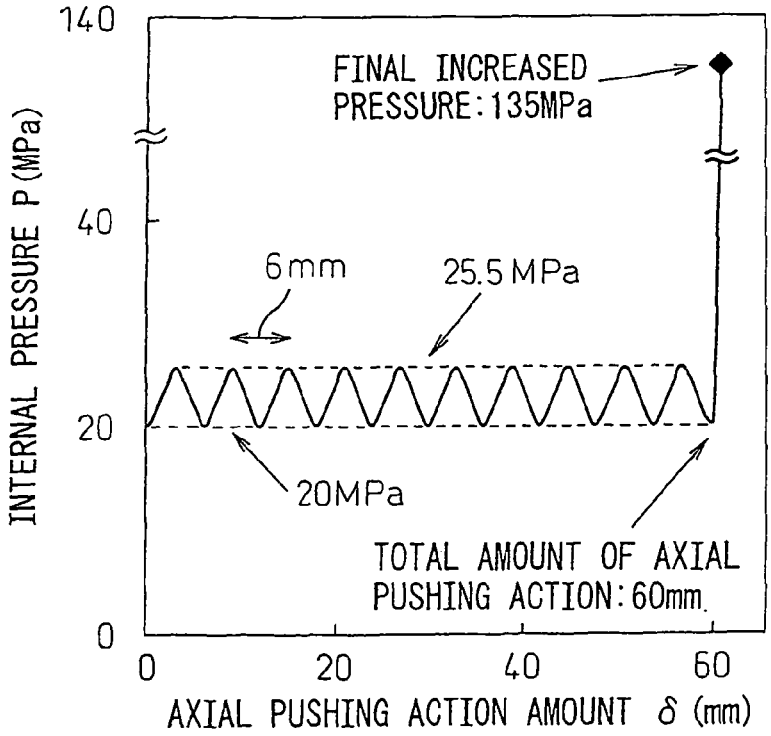

FIG. 11 is an explanatory view of a conventional load path cyclically changing the load for comparison.

Figure 12:
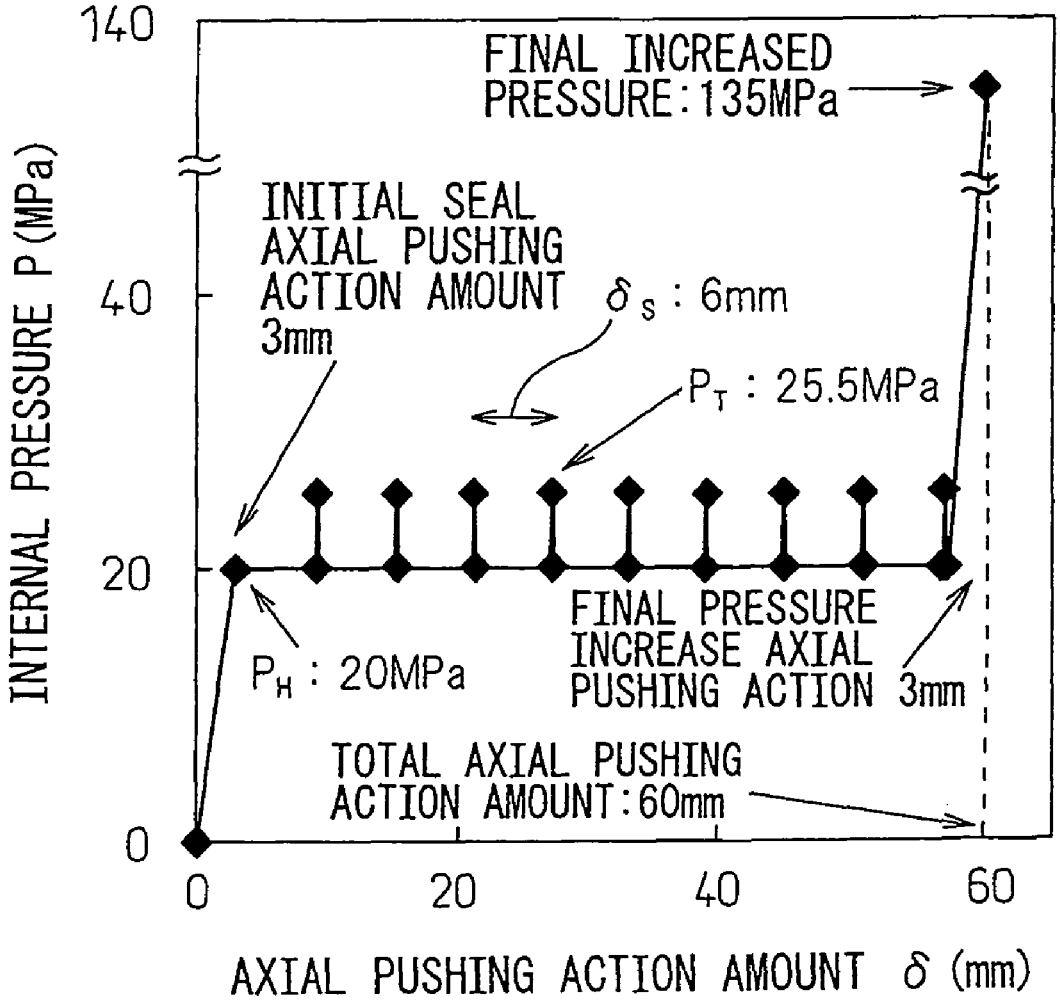

FIG. 12 is an explanatory view of a load path used in Example 3 and Example 4 of the present invention.

Figure 13:
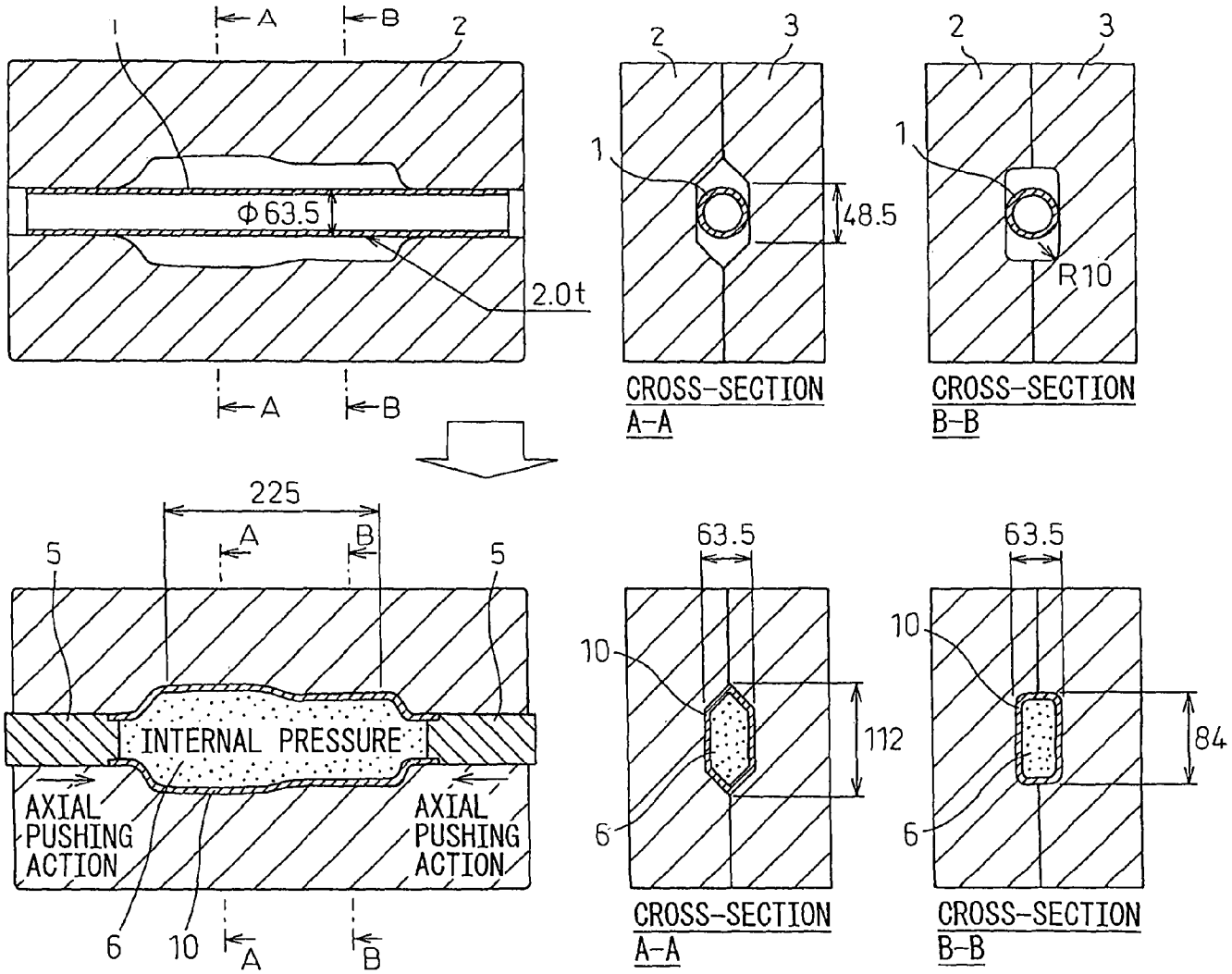

FIG. 13 is an explanatory view of a case of the cross-sectional shape changing in the tube axial direction by the method of the present invention.

*a*: example of state with metal tube set inside mold

*b*: example of state of metal tube finished being worked

Figure 14:
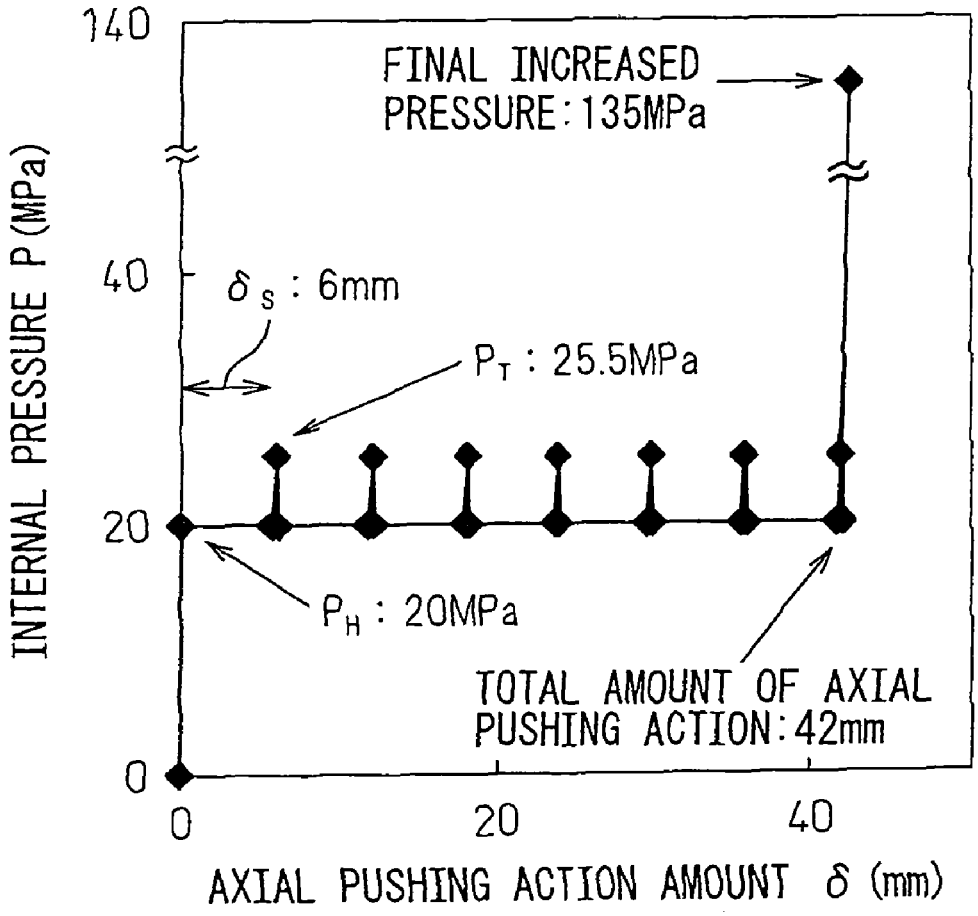

FIG. 14 is an explanatory view of a load path used in Example 5 of the present invention.

BEST MODE FOR CARRYING OUT THE INVENTION

FIGS. 4*a* and 4*b* show an example of setting a circular cross-section metal tube 1 in hydroform molds 2 and 3 and expanding it by hydroforming to shape it into a hydroformed product 4 having a rectangular cross-section. For example, a steel pipe of an outside diameter of 63.5 mm and a wall thickness of 2.0 mm (steel type: JIS STKM13B) is expanded to a rectangular cross-section of 63.5 mm×84 mm (corner roundness R=10 mm). The expansion rate in that case is 1.39. Further, the length of the region with an expansion rate of 1.39 is 320 mm (5 times the outside diameter of 63.5 mm).

Below, using as an example working by that hydroform mold, embodiments of the present invention will be explained along the flow path shown in FIG. 5 and the trends in deformation shown in FIG. 6.

First, at stage 1, in the same way as the above method, without applying an axial pushing action, a pressure medium (for example, water) 6 is fed into the metal tube 1 to raise the pressure by only the internal pressure. However, in some cases, to prevent seal leakage from the tube ends, sometimes slight axial pushing actions of 10% of the total axial pushing amount or less are applied. This initial pressure $P_H$ is the pressure at which the metal tube plastically deforms without cracking and is found relatively easily by calculation or experiments.

For example, the present inventors engaged in research and as a result learned that a yield start pressure $P_p$ in a planar strain state of a metal tube (see following formula (1)) can be used as a yardstick for the initial pressure $P_H$ (see Non-Patent Document 2). Note that the "D" on the formula indicates the outside diameter of the original tube (mm), "t" the wall thickness (mm), and "r" the r value, and "YS" and "$YS_p$" indicate the 0.2% yield strengths in the single-axis tension state and planar strain state.

$$P_p = 2YS_p \frac{t}{D-t},\ YS_p = \frac{1+r}{\sqrt{1+2r}} YS \tag{1}$$

However, when the shape is complicated etc., the error from the above formula becomes larger, so it is more reliable to find the initial pressure $P_H$ experimentally. Specifically, the initial pressure $P_H$ is set with reference to the pressure when cracking when raising the internal pressure until the metal tube cracks without applying any axial pushing action. For example, it is set to a pressure of 0.7 to 0.8 time the pressure at the time of cracking.

In the above way, the internal pressure is raised until the initial pressure $P_H$ found by calculation or experiment. This state corresponds to the stage 1 in FIG. 5. As a result of research of the inventors, at the point of time of the state 1 when only the pressure was raised without application of any axial pushing action, the metal tube is expanded the most at the center part (part M of state 1 of FIG. 6*a*).

Next, the stage 2 where the internal pressure and axial pushing actions are applied is entered.

First, while holding the internal pressure at the initial pressure $P_H$, the axial pushing punches 5 are made to advance to apply only axial pushing actions. This operation is called the "first step" as shown in the enlarged view of the load path of FIG. 5.

As a result of research of the inventors, even with application of only axial pushing actions without increasing the internal pressure, the metal tube is expanded, but in this case, the expansion proceeds not from the center part, but near the ends (part $N_1$ of state 2 of FIG. 6*b*). Expansion from near the ends becomes a cause of buckling or wrinkles in the hydroforming. The extent of this buckling or wrinkles can be eased to a certain extent by increasing the internal pressure during the axial pushing action, but cannot be completely eliminated. Further, if overly raising the internal pressure, the danger of cracking rises. Accordingly, to find a suitable load path of the internal pressure and axial pushing action, tremendous trial and error and skill are required.

As opposed to this, with this method, the value of the internal pressure remains as held, so by expansion during an axial pushing action, there is almost no possibility of cracking. Further, the only variable in the load path is the amount of the axial pushing action, so the method is extremely simple.

The axial pushing action amount $\delta_S$ (mm) up to the state 2 has to be suppressed to an amount of axial pushing action of an extent enabling elimination of wrinkles in the later steps. As the method for finding the suitable axial pushing action amount $\delta_S$, it is sufficient to stop changing the amount of axial pushing action in the middle, obtain a sample, and select an amount of axial pushing action of an extent not resulting in large wrinkles. The value of the suitable axial pushing action amount $\delta_S$ differs depending on the formed shape and the dimensions and strength of the material tube, but from the results of research of the inventors, about 2 to 4 times the wall thickness of the material tube is preferable. Further, about 3 times is preferable.

Next, the axial pushing actions are stopped and only the internal pressure is raised. This operation is called the "second step". In this step, no axial pushing actions are applied, so the expansion proceeds again at the center part (part M of state 3 of FIG. 6*c*). This being the case, in the state 3, a uniform expanded shape is approached in the tube axial direction and the progression of buckling or wrinkles is suppressed. The top peak pressure $P_T$ (MPa) at this time is preferably right at the edge where the metal tube will not crack. That is, a pressure somewhat lower than the pressure at which cracking occurs without any axial pushing action when finding the initial pressure $P_H$ as explained above, for example, 0.90 to 0.99 time the pressure at cracking, is preferable. Setting it to about 0.95 is more preferable.

After this, while stopping the axial pushing actions, the pressure is lowered once to the initial pressure $P_H$. This process is called the "third step". Even if setting a load path of a step shape applying axial pushing actions without lowering the internal pressure at the pressure $P_T$, the pressure is too high, so the metal tube immediately ends up cracking. Accordingly, the third step of increasing the pressure to the peak pressure $P_T$, then lowering it once to the initial pressure $P_H$ has extremely important meaning in the method of the present invention.

If similarly repeating the first step to the third step in the above way, the tube is alternately expanded at the center part and near the ends and becomes a uniformly expanded shape in the tube axial direction. Further, as shown in FIG. 7, sometimes a plurality of expanded parts appear such as the part N2 at the inside of the part N1. However, the basic effect of the method of the present invention remains unchanged. A uniform tube shape in the tube axial direction is obtained.

If repeating the above first to third steps one or more times, finally, as shown in FIG. 8, the tube contacts the mold over substantially its entire length across the tube axial direction. In this state, due to the constraining force of the mold, cracking becomes difficult, so stage 3 of raising only the internal pressure while keeping the axial pushing actions stopped is performed to form the detailed shapes and sharp radii of curvature of the corners. However, in some cases, to prevent seal leakage from the tube ends, it is also possible to apply slight axial pushing actions of 10% or less of the total amount of the axial pushing action while raising the internal pressure.

Above, an embodiment of the method for hydroforming proposed in the above (1) was explained. Application of this method to hydroforming using movable molds however corresponds to the method proposed in (2).

Below, an embodiment of this method will be explained.

In this method, as shown in FIG. 9, a hydroform mold comprised, of stationary molds 7 and 8 and movable molds 9, 9 is used. The movable molds 9 are designed to be able to move inside the mold in the rectangular cross-section of the stationary molds 7 and 8. When applying an axial pushing action to the two ends of the metal tube 1, the movable molds are also simultaneously subjected to the axial pushing action so the expanded parts can be simultaneously pushed in by the movable molds.

Even when using the movable molds 9, in the same way as the case of applying the axial pushing action to only the tube ends, it is possible to use the load path explained using FIG. 5.

The metal tube set as in FIG. 9*a* is subjected to a stage 1 where the internal pressure is raised in the state fixing the positions of the two ends of the metal tube 1 and movable molds 9 or in the state applying an axial pushing action of 10% or less of the total amount of the axial pushing action.

Next, at stage 2, first, a first step is performed of holding the internal pressure at a constant pressure while simultaneously applying axial pushing actions to the two ends of the metal tube 1 and the movable molds 9 to thereby expand the metal tube 1 near the ends, then a second step is performed of raising only the internal pressure to thereby expand the center part of the metal tube 1, then a third step is performed of lowering the internal pressure to the value of the constant pressure. Further, the first to third steps are repeated one or more times to form the tube into the product shape, then, in a state without applying any axial pushing action or applying axial pushing actions of 10% or less of the total amount of the axial pushing action, the internal pressure is raised to obtain the hydroformed product 4 such as in FIG. 9*b*.

This method using movable molds, compared with the method of pushing only the tube ends, enables the reduction of the wear resistance of the non-expanded parts, so a large expansion rate can be achieved. However, with this method, at the time of the initial start of working, there will be an expanded region longer than the shape of the worked part desired to be finally obtained, so the conventional method had the problem that buckling or wrinkles in the tube axial direction occurred more easily than with a usual hydroformed product.

As opposed to this, according to the present invention, by using the load path explained above, it is possible to eliminate the above problems of buckling or wrinkles even if using movable molds, so further great effects can be exhibited.

If using such a series of hydroforming methods (usual hydroforming method and hydroforming method using movable molds), even a part long in the tube axial direction will not be left with buckling or wrinkles and a part with a large expansion rate can be obtained. Specifically, it is possible to obtain a hydroformed product with a region of an expansion rate of 1.35 or more continuing in the tube axial direction for a length of 3.5 times or more the diameter of the material tube—impossible with the conventional method. However, in the above, the explanation was given of the example of an extremely long region with an expansion rate of 1.35 or more or 5 times the diameter of the material tube.

EXAMPLES

Below, examples of the present invention will be shown.

Example 1

For the tube, steel pipe of an outside diameter of 63.5 mm, a wall thickness of 2.0 mm, and a length of 600 mm (steel type: JIS standard STKM13B) was used. The material characteristics were a YS of 385 MPa and an r value of 0.9. For the hydroform mold, the mold of FIG. 4 explained above was used. As the pressure medium, water was used.

The load path of the hydroforming is shown in FIG. 10. That load path was determined by the following routine.

First, if using the above-mentioned formula (I) to calculate the yield start pressure Pp in the planar strain state, it was 28.4 MPa. However, when actually raising the internal pressure without applying an axial pushing action until that steel pipe cracked, it cracked at 26.5 MPa. Accordingly, the initial pressure $P_H$ was set at 20 MPa or 0.76 time the actual cracking pressure of 26.5 MPa, while the top peak pressure PT was set at 25.5 MPa or 0.96 time the 26.5 MPa. Next, the amount of axial pushing action $\delta_S$ per cycle was set at 6 mm or 3 times the wall thickness of 2 mm of the material tube. Therefore, when running a test comprising several cycles of an initial pressure $P_H$: 20 MPa, top peak pressure PT: 25.5 MPa, axial pushing action amount $\delta_S$: 6 mm, the tube contacted the mold over substantially the entire length at 10 cycles. Therefore, the operation was repeated for a total of 10 cycles, that is, until the final axial pushing action amount of 60 mm, then the axial pushing action was stopped and only a high internal pressure was applied. The final pressure was set at 135 MPa as a sufficient pressure for the radius of curvature R of the corner to become R=10 mm in the same way as the mold.

The suitable load path such as shown in FIG. 10 was determined by such a routine whereby a hydroformed product with no buckling or wrinkles or other working defects was obtained. Note that if trying to find a suitable load path by a broken line load path as in the past, the buckling or wrinkles of the worked part could not be eliminated even if repeating a trial and error process for a total of 50 times. On the other hand, with the load path according to the present invention, it was possible to obtain a suitable load path such as in FIG. 10 the fourth time after repeating the trial and error process a total of three times.

In the hydroformed product obtained by the present invention, the circumferential length of the cross-section expanded into a rectangular shape was 278 mm. This corresponds to an expansion rate of 1.39 times the 63.54 tube. Further, the length in the tube axial direction in the cross-section having that expansion rate was 320 mm or 5.0 times the 63.5 mm outside diameter of the tube. In this way, a long hydroformed product with a large expansion rate, impossible by the conventional hydroforming, could be obtained by the method of the present invention.

Further, for comparison, the inventors attempting hydroforming by a cyclically changing load path as described in the above Patent Document 2. The load path is shown in FIG. 11. Matching with the cycle of the method of the present invention of the initial pressure $P_H$ of 20 MPa, the top peak pressure $P_T$ of 25.5 MPa, and the amount of axial pushing action $\delta_S$ of 6 mm, the cyclic waveform was made a sine wave of the low pressure side peak pressure of the waveform of 20 MPa, a high pressure side peak pressure of 25.5 MPa, and a wavelength of 6 mm. The number of cycles was also made the same 10 cycles. After applying the axial pushing action to 60 mm, the pressure was raised to 135 MPa for the load path.

However, when actually performing the hydroforming, the tube ended up immediately cracking at the first cycle. This is believed to be because, unlike the method of the present invention, the pressure during the axial pushing action is high. For safety's sake, the pressure was lowered by 3 MPa as a whole and similar working applied, whereupon cracks could be prevented, but large wrinkles remained after the end of the work. This is believed to be because, unlike the method of the present invention, at the time of raising the pressure in the cycle, an accompanying axial pushing action is applied, so wrinkles easily form.

Example 2

Using the same material tube as in Example 1, a hydroformed product of the same shape as in Example 1 was attempted to be worked by a hydroform mold using movable molds shown in FIG. 9. To realize a length of the expanded part in the final worked shape, at the initial stage of the work, the movable molds were retracted 60 mm in advance. Otherwise, the work was applied by the load path of FIG. 10 the exact same as Example 1. As the pressure medium, water was used.

As a result, in the hydroformed product obtained by the present invention, the circumferential length of the cross-section expanded into a rectangular shape was 278 mm. This corresponds to an expansion rate of 1.39 times the 63.5ϕ material tube. Further, the length in the tube axial direction in the cross-section having that expansion rate was 320 mm or 5.0 times the 63.5 mm outside diameter of the material tube. In the same way as in Example 1, a part with no buckling or wrinkles or other working defects was obtained. Further, Example 2 was able to utilize the load path of Example 1 as is, so no trial and error at all was required.

Example 3

Using the same metal tube and the same mold as in Example 1, hydroforming was performed by the load path shown in FIG. 12. The load path, unlike the load path of FIG. 10, raises the tube end sealability when raising the initial pressure by applying slight axial pushing actions of 3 mm. Furthermore, to raise the tube end sealability when finally raising the pressure, a slight axial pushing action of 3 mm was applied. The load path during that interval was basically made the same as the case of FIG. 10, but to make the total amount of axial pushing actions the same 60 mm, the number of cycles was reduced by 1. As a pressure medium, water was used.

As a result, in the hydroformed product obtained by the present invention, the circumferential length of the cross-section expanded into a rectangular shape was 278 mm. This corresponds to an expansion rate of 1.39 times the 63.5 ϕ tube. Further, the length in the tube axial direction in the cross-section having that expansion rate was 320 mm or 5.0 times the 63.5 mm outside diameter of the tube. Even if using this load path, in the same way as Example 1, a long hydroformed product with a large expansion rate could be obtained by the method of the present invention.

Example 4

Using the load path of FIG. 12 used in Example 3, the same metal tube and same mold as in Example 2 were used for hydroforming. As the pressure medium, water was used.

As a result, in the hydroformed product obtained by the present invention, the circumferential length of the cross-section expanded into a rectangular shape was 278 mm. This corresponds to an expansion rate of 1.39 times the 63.5 ϕ tube. Further, the length in the tube axial direction in the cross-section having that expansion rate was 320 mm or 5.0 times the 63.5 mm outside diameter of the tube. With this working method as well, a long hydroformed product with a large expansion rate could be obtained by the method of the present invention.

Example 5

FIG. 13 shows an example in the case where the cross-sectional shape changes in the tube axial direction. However, in the expanded region (region of 225 mm length in the figure), the expansion rate is 1.35 or more no matter what the cross-section. The metal tube used in this example was a steel pipe the same as that used in the above Examples 1 to 4. Further, the load path is shown in FIG. 14. Basically, the load path is almost the same as that of FIG. 10 used in Example 1, but the expanded region is shorter than Example 1 and the amounts of axial pushing actions become smaller correspondingly. By the above such method, a hydroformed product 10 having a region with an expansion rate of 1.35 or more of 225 mm (about 3.5 times the 63.5 mm diameter of the tube) and having a cross-sectional shape changed in the tube axial direction was obtained.

INDUSTRIAL APPLICABILITY

According to the present invention, hydroforming of a shape with a long expanded region becomes easy. Due to this, the range of application of hydroformed products is expanded and parts can be combined and weight reduced. In particular, application to auto parts will enable vehicles to be reduced in weight more and therefore improved in fuel economy and as a result will contribute to suppression of global warming. Further, greater application in industrial fields not applied to much in the past, for example, household electrical applications, furniture, construction machinery parts, motorcycle parts, building materials, etc. can be expected.

Explanation of Notations

1 metal tube
2, 3 hydroform mold
4 hydroformed product
5 axial pushing action punch
6 pressure medium
7, 8 stationary molds in hydroform mold
9 movable molds in hydroform mold
10 hydroformed product changed in cross-sectional shape in tube axial direction

The invention claimed is:

1. A method for hydroforming a metal tube, having two ends and an inside, by feeding a pressure medium into an inside of a metal tube to apply internal pressure, and applying an axial pushing action to the two ends of the metal tube to form the metal tube into a predetermined shape;

the method for hydroforming a metal tube comprising:

a first step of raising the internal pressure with the pressure medium in the metal tube, while maintaining the two ends of the metal tube in a fixed position; or applying an axial pushing action in an amount of 10% or less of the total amount of axial pushing action, and then applying an axial pushing action while holding the internal pressure at a constant pressure to expand the metal tube near the ends, then a second step of raising only the internal pressure with the pressure medium to thereby expand a center of the metal tube without applying any axial pushing action and then a third step of lowering only the internal pressure to the value of the constant pressure without applying an axial pushing action, and then repeating the first to third steps one or more times, and then raising the internal pressure with the pressure medium, while maintaining the two ends of the metal tube in a fixed position; or applying an axial pushing action of no more than 10% of the total axial pushing action; wherein the total axial pushing action is the axial pushing action applied while holding the internal pressure at a constant pressure in the first step.

2. A method for hydroforming a metal tube, having two ends and an inside, by feeding a pressure medium into an inside of a metal tube to apply internal pressure, applying an axial pushing action to the two ends of the metal tube, and simultaneously applying an axial pushing action to movable molds in which the metal tube is positioned to form the metal tube into a predetermined shape, the method for hydroforming a metal tube comprising:

a first step of raising the internal pressure with the pressure medium in the metal tube, while maintaining the two ends of the metal tube in a fixed position; or applying an axial pushing action in an amount of 10% or less of the total amount of axial pushing action, and then simultaneously applying an axial pushing action to the two ends of the metal tube and the movable molds while holding the internal pressure at a constant pressure to expand the metal tube near the ends, a second step of raising only the internal pressure with the pressure medium to thereby expand a center of the metal tube without applying an axial pushing action to the two ends of the metal tube and without applying an axial pushing action to the movable molds, and a third step of lowering only the internal pressure to the value of the constant pressure without applying an axial pushing action to the two ends of the metal tube and without applying an axial pushing action to the movable molds, then repeating the first to third steps one or more times, and then raising the internal pressure with the pressure medium, while maintaining the two ends of the metal tube in a fixed position; or applying an axial pushing action of no more than 10% of the total axial pushing action; wherein the total axial pushing action is the axial pushing action applied while holding the internal pressure at a constant pressure in the first step.

* * * * *